US005123817A

United States Patent [19]

Willemsen

[11] Patent Number: 5,123,817

[45] Date of Patent: Jun. 23, 1992

[54] VAPOR EXHAUST SYSTEM

[75] Inventor: Henricus J. A. Willemsen, Bladel, Netherlands

[73] Assignee: Koppens Automatic Fabrieken B.V., Bladel, Netherlands

[21] Appl. No.: 565,590

[22] Filed: Aug. 10, 1990

[30] Foreign Application Priority Data

Aug. 11, 1989 [NL] Netherlands ..... 8902045

[51] Int. Cl.[5] ..... F04B 17/00; B65B 3/18

[52] U.S. Cl. ..... 417/404; 141/59; 141/290; 91/349

[58] Field of Search ..... 417/404, 403, 398; 91/343, 349, 341 R, 341 A, 352, 354; 141/59, 60, 46, 290

[56] References Cited

U.S. PATENT DOCUMENTS

| | | | |
|---|---|---|---|
| 6,620 | 8/1875 | Winchester | 91/349 |
| 15,211 | 5/1856 | Henry | 91/341 R |
| 376,271 | 11/1888 | Stewart | 91/349 |
| 437,941 | 10/1890 | Shoemaker | 91/349 |
| 1,189,766 | 7/1916 | Wilkin | 417/398 |
| 1,746,165 | 2/1930 | Porte | 417/404 |
| 2,854,826 | 10/1958 | Johnston | 417/404 |
| 3,234,746 | 2/1966 | Cope | 417/404 |
| 3,826,291 | 7/1974 | Steffens . | |
| 4,223,706 | 9/1980 | McGahey | 417/404 |

FOREIGN PATENT DOCUMENTS

| | | |
|---|---|---|
| 0282358 | 9/1988 | European Pat. Off. . |
| 2814270 | 10/1979 | Fed. Rep. of Germany . |
| 497743 | 6/1937 | United Kingdom . |

OTHER PUBLICATIONS

GB 497,743, Jun. 24, 1937; Bennet.

DE 28 14270 A1, Oct. 11, 1979; Texaco Development Corp.

U.S. 3,826,291, Jul. 30, 1974; Steffens.

EPA 0 282 358, Sep. 14, 1988; Parker Hannifin Corp.

*Primary Examiner*—Richard A. Bertsch
*Assistant Examiner*—Peter Korytnyk
*Attorney, Agent, or Firm*—Pennie & Edmonds

[57] ABSTRACT

A vapor exhaust system including a volumeter 5 to which an air pump 7 has been coupled mechanically so that the volume of a certain amount of pumped liquid corresponds to the amount of air pumped from a fuel tank. A translatory or rotary motion provides the signal to maintain this correspondence, in which case the drive shaft 10 of the volumeter 5 is coupled to the air pump which may be executed as a gear pump. If desired, the coupling may be executed as a gear transmission 22.

3 Claims, 2 Drawing Sheets

VAPOR EXHAUST SYSTEM

BACKGROUND OF THE INVENTION

The invention concerns a system for pumping a liquid and a corresponding amount of vapor, which system includes a tank, a pump and a volumeter which are all interconnected with pipes for the displacement of liquid from one tank to another, and which system has an air pump for pumping a corresponding amount of vapor in the opposite direction.

Similar systems are used not only in pump stations such as gasoline pump stations, but also in pump stations in industrial complexes where more or less noxious, or maybe volatile, liquids need to be pumped from one storage tank to another without causing any vapor which has formed, or is being formed in the collection tank, from being released into the environment by way of the intake. Not only are such vapors pollutants but, because they are derived from the liquid, the loss of such vapors represents also a waste of the liquid. Obviously, both the environmental pollution and the waste are unacceptable.

To prevent these problems, known systems have been developed which make use of two—generally—electrical pumps, whereby one pump in installed in the pipe for the liquid which in general contains also a volumeter, and the other pump is installed in the air pipe. When the pump for the liquid is turned on the air pump is also activated, as a result of which, during the operation of the system, the volume of liquid displaced over a certain period of time will correspond to the displaced volume of air. The simultaneous activation of both pumps occurs in the known system by means of switches, e.g., electrical switches, which must be installed on each pump.

The disadvantage of the known system is that, although the volume of the liquid displaced during stationary operation of the system corresponds to the volume of displaced air, when the pumping process is examined in its entirety, the volume of the displaced liquid does not correspond with sufficient accuracy to the volume of displaced air.

SUMMARY OF THE INVENTION

The purpose of the invention is to create a simple and low-cost system for pumping liquids, whereby the amount of the displaced liquid corresponds within narrow boundaries to the amount of displaced vapor, not only during stationary operation of the system but also during transitional situations, i.e., when the system is being turned on or off.

The system according to the invention is therefore characterized by the fact that the volumeter is designed to release a signal which is a measure for the actual rate of the liquid at the volumeter, which signal is fed to the air pump to cause a displacement in the opposite direction of a corresponding amount of vapor which is directly proportional to the actual rate of the liquid determined by the volumeter.

The system according to the invention is governed by the concept that the actual rate of the liquid at the volumeter must serve as a measure for pumping a corresponding amount of air, in order to achieve correspondence between the two displaced volumes within narrow boundaries. Indeed, it is an important constant that the mass inertia of the liquid flow is not equal to the mass inertia of the vapor to be displaced. As a result, when the known system is activated, some air will be displaced even before the liquid starts to flow, which means that some vapor will escape from the tank from which the liquid is being pumped while. On the other hand, when both pumps are turned off, the liquid will stop flowing at a later point than the air, which means that at the tank to which the liquid is being pumped, some vapor will be released into the environment. This effect is reinforced in the known system by the fact that the volumeter installed in the pipe for the liquid will act as an obstruction and thus slow down the flow, thereby increasing even further the difference between the volumes of the liquid and the air.

In the system according to the invention, any slowing effect on the part of the liquid and the volumeter is fully compensated because the final rate of the volumeter is included as a determining factor in the process which causes the simultaneous and directly proportionate displacement of a corresponding volume of air. As a result, the act of turning the system on or of will no longer affect the degree of accuracy with which both volumes correspond to one another. It is obvious that the system according to the invention represents a very clear improvement over the known system when applied in, e.g., gasoline stations, where pumping systems are turned on and off on a very regular basis by large numbers of drivers. Another advantage is that the system under consideration can be designed to operate with either electrical or mechanical means.

Another embodiment of the system according to the invention, this time designed as a mechanical system, is characterized by the fact that the volumeter is executed as a mechanical volumeter with moving parts, whose movement is a measure for the actual rate of the volumeter, and that the air pump is a mechanical pump to which the signal—in the form of the movement of the parts—is fed in order to cause the actual liquid rate of the volumeter to correspond to the actual rate of the air pump, in a mechanical manner.

A particularly simple system according to the invention, based solely on the cylinder principle, is characterized by the fact that the volumeter includes at least one cylinder and at least one corresponding piston connected to a crankshaft, which piston moves inside the cylinder, and whose movement is a measure for the actual rate of the liquid of the volumeter, that the air pump includes a cylinder and a corresponding piston which moves inside the cylinder of the air pump, that the respective displacement volumes of the cylinder and piston combinations of the volumeter and the air pump are the same, and that both pistons are linked to each other by means of a common rod.

In this system the translatory motion of the piston supplies the signal on the basis of which the desired amount of air to be displaced by the air pump is determined.

Another system according to the invention, which is also suitable for high rates, is characterized by the fact that the volumeter includes two pistons with cylinders, which pistons are connected by means of a piston rod, and a crankshaft which rotates with the piston rod and is made to rotate by a translatory motion of the piston rod, that one end of the crankshaft is equipped with a valve whereby, when the crankshaft is turned, the valve alternately opens two passageways into the corresponding cylinders in the direction of an outgoing pipe of the volumeter, that the resulting double-action volumeter is executed with a piston rod extended to be a common rod, to which the piston of the air pump is attached, which piston divides the cylinder of the air pump into two sections, which sections are each equipped with a pair of valves to create a double-action air pump. An advantage worth mentioning of the system according to the invention is that these valves may be automatic valves, eliminating the need for a complicated control-/adjustment system to control them.

An embodiment according to the invention in which the rotation of the crankshaft of the volumeter supplies the signal which serves as basis for determining the desired amount of air to be displaced, is characterized by the fact that the volumeter includes at least one cylinder and at least one corresponding piston connected to a crankshaft, which piston moves inside the cylinder, whereby the rotating movement of the crankshaft contains a measure for the actual rate of liquid of the volumeter, that the pump is a gear pump and includes a drive shaft coupled to the crankshaft of the volumeter.

A further embodiment according to the invention is characterized by the fact that the system includes a gear transmission between the crankshaft of the volumeter and the drive shaft of the gear pump, and that the transmission ratio of the gear transmission is such that per time unit the rate of liquid of the volumeter corresponds to the air rate of the gear pump.

The advantage of this embodiment according to the invention is that the selection of the transmission ratio of the gear transmission allows the use of gear pumps with different air rates, at least as long as the combined gear pump transmission has a rate per unit of time which is basically the same as the liquid rate of the volumeter.

DESCRIPTION OF THE DRAWINGS

The invention is further explained by means of the following figures in which corresponding elements bear the same reference numbers.

DESCRIPTION OF THE PREFERRED EMBODIMENTS

Figure 1:
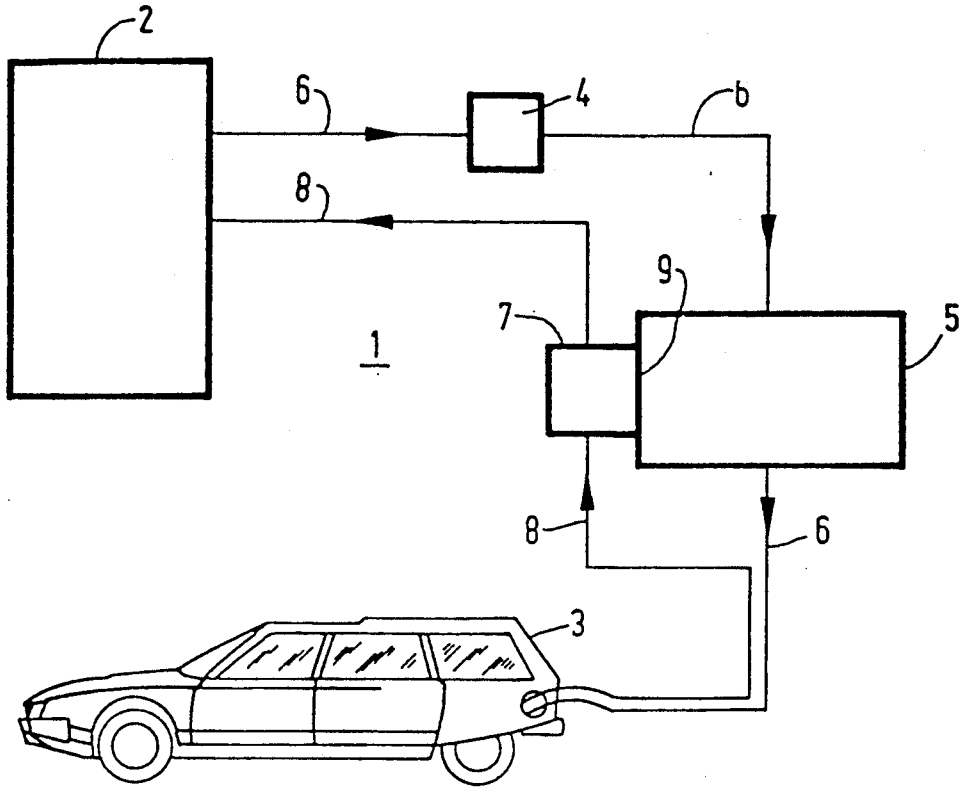
FIG. 1 is a schematic rendering of the system according to the invention.

FIG. 1 shows a system 1 for pumping a liquid from a tank 2, e.g., a storage tank, to a tank—not shown—in, e.g., a car 3. System 1 contains a pump 4 connected in series with a volumeter 5 and linked to it by way of pipes 6 through which liquid is pumped from tank 2 to the other tank in car 3. The volumeter 5 is coupled to an air pump 7 which is connected to air pipes 8 by way of an interface 9. Information is transmitted by means of a signal—which is a measure for the actual liquid rate of the volumeter—between the volumeter 5 and the air pump 7 in such manner that as a result the actual rates of the volumeter 5 and the air pump 7 correspond with one another. The result is that at each moment of the cycle in which liquid is being pumped, the amount of air to be pumped in the opposite direction will correspond exactly to the volume of the displaced liquid, so that the vapor pressure in tank 2 or tank 3 in the car will at no time in the cycle be excessive or insufficient.

The signal transmitted by way of interface 9 is a measure for the actual rate of volumeter 5. This signal may be electrical, pneumatic or mechanical, as desired. If the volumeter is electrical, the meter will generally release an electrical signal to a counter—not indicated, which electrical signal is a measure for the actual rate of volumeter 5. In this case the electrical signal can be transmitted by way of interface 9 to air pump 7, in order for the electrical air pump 7 to pump a volume of air corresponding to the volume of liquid displaced by volumeter 5. If a volumeter of another type is used it will release, e.g., a pneumatic signal, whose actual pressure will be a measure for the actual rate of the liquid. In that case, a pneumatic signal can be used—possibly after conversion to an electrical or mechanical signal—to control the actual air rate of air pump 7. If, on the other hand, volumeter 5 is executed as a mechanical volumeter, it will be possible to use, e.g., the rotation speed of a crankshaft, or the translatory motion of a piston, as signals for transmission to air pump 7 by way of interface 9.

Figure 2:
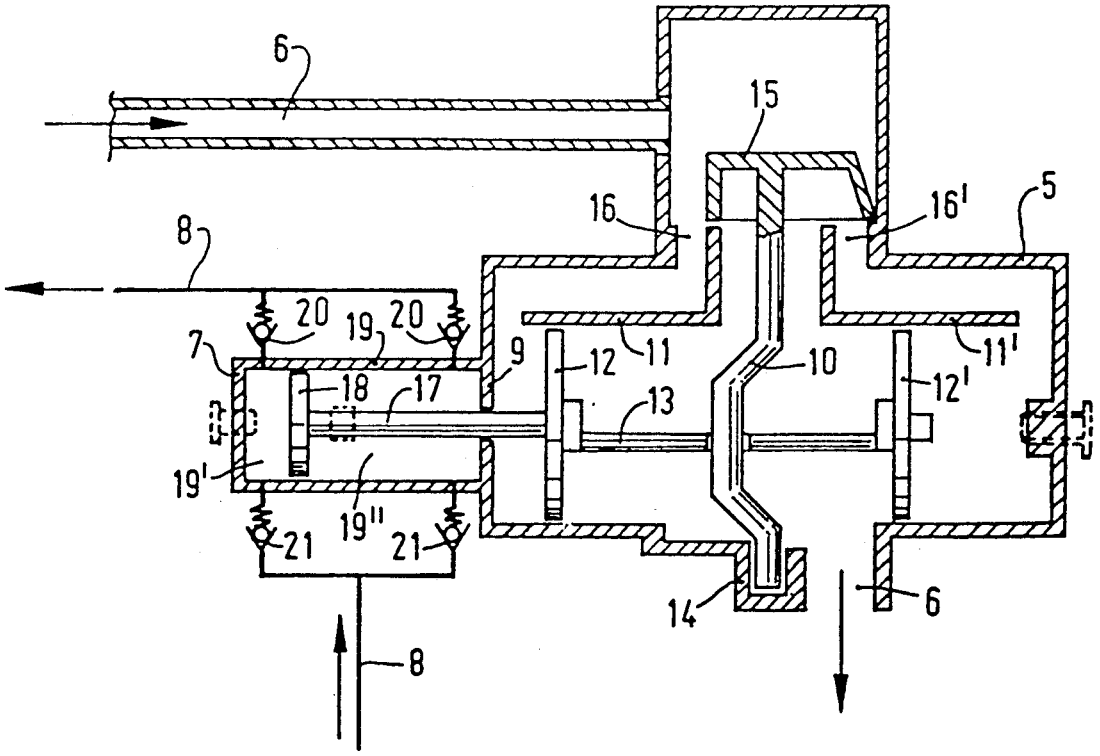
FIG. 2 is a detailed, mechanically executed volumeter with an air pump for application in the system according to FIG. 1.
Figure 3:
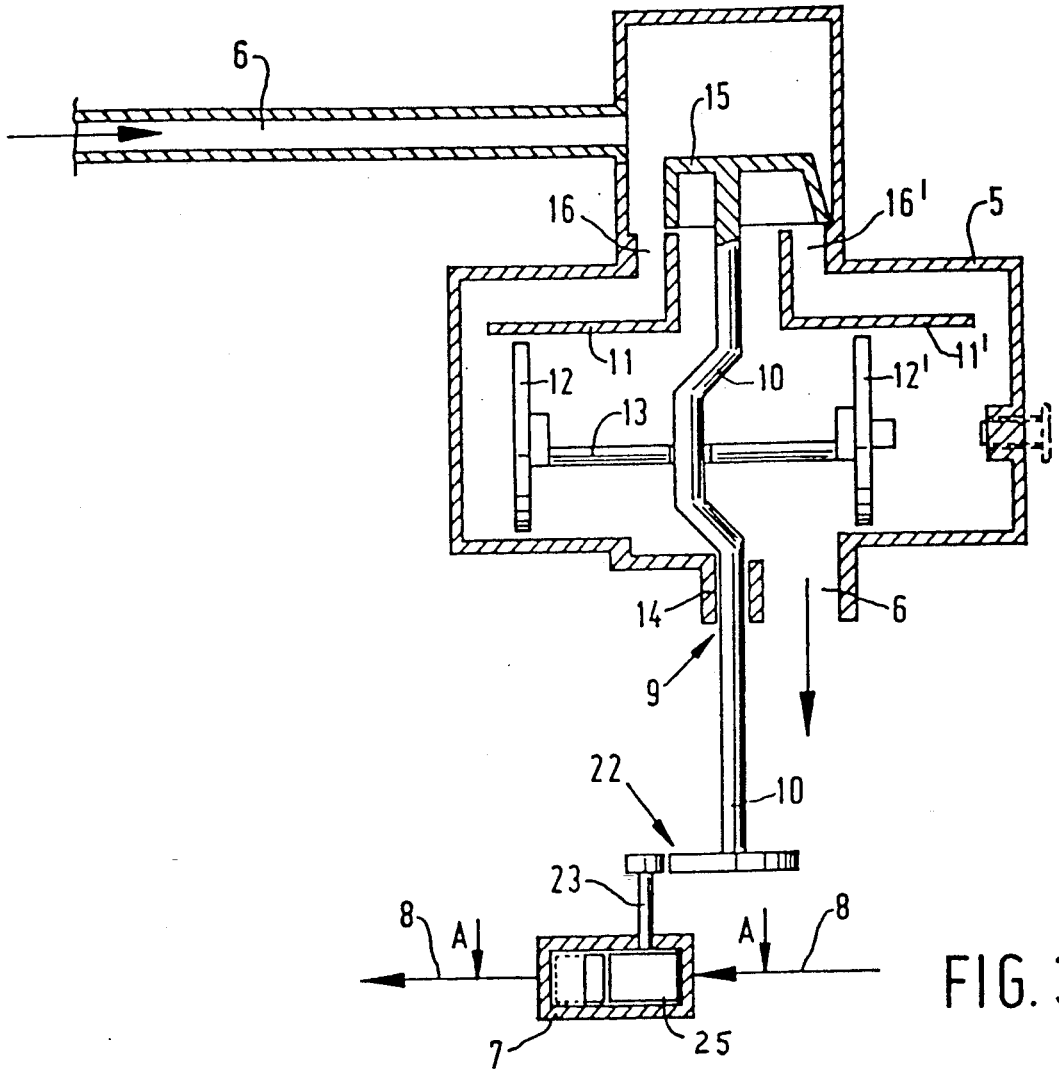
FIG. 3 shows a further detailed, mechanically executed volumeter which is connected to an air pump by way of a gear transmission for application in the system according to FIG. 1.

FIGS. 2 and 3 show an embodiment of, in particular, a volumeter 5 with an air pump 7, whereby the transmission by way of the interface 9 takes place mechanically. In particular, in the embodiment according to FIG. 2, a translatory motion is transmitted by way of interface 9. In this specific embodiment, in which the volumeter 5 and the air pump are designed for double action, the volumeter 5 includes a crankshaft 10, and cylinders 11 and 11' with pistons 12 and 12' moving inside the cylinders, which pistons are interconnected by means of a piston rod 13. The piston rod 13 rests on bearings in the crankshaft 10. In the embodiment according to FIG. 2, one side of the crankshaft 10 rests on a kind of tapered bearing 14, while at the other side the crankshaft 10 is attached to a valve 15. The valve 15 is executed in such manner that, dependent upon the position of the crankshaft 10, it will, as the crankshaft turns, alternately open and close passageways 16 and 16' into the cylinders 11 and 11' so that the liquid which pump 4 forces to enter by way of pipe 6, is now transferred to pipe 6 by means of the double-action pump. The actual position of the pistons 12 and 12', or the derived position, is a measure for the actual rate of volumeter 5. The piston rod 13 extends into a common rod 17 which projects through the interface 9 by which the—in this case—mechanical signal, which is a measure for the actual rate of the volumeter 5, is transmitted to the air pump executed in this case as a double-action air pump 7. A piston 18 is attached to the common rod 17, which piston moves inside the cylinder 19 of the air pump 7. Piston 18 divides the cylinder 19 into two sections, i.e., 19' and 19''. Each of these sections 19' and 19'' of the cylinder 19, are connected to pairs of valves 20 and 21. The valves 20 are connected to pipe 8 for guiding the vapor to the tank 2, while the valves 21 on the other side of the air pump 7 are also connected to pipe 8, by means of which vapor is pumped from the tank in the car 3. In this embodiment, both the air pump 7 and the volumeter 5 have a double action. It is clear that the principle presented above can also be applied in single-action pumps and also, as mentioned earlier, in electrical executions, among others, of volumeter 5 and air pump 7.

In the embodiment of FIG. 3, a crankshaft 10 has been extended and projects through the interface 9. The crankshaft 10 is coupled by way of a gear transmission 22 to a drive shaft 23 of the rotating air pump 7, preferably executed as a gear pump. Air pipes 8 are connected to the pump 7.

Figure 4:
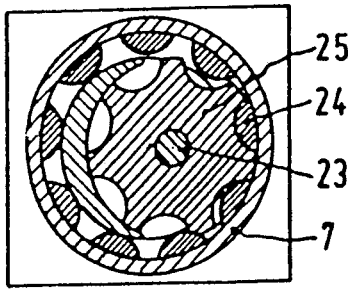
FIG. 4 is a rendering in longitudinal section along line A—A of the air pump shown in FIG. 3.

FIG. 4 shows a cross-section along line A—A of the gear pump 7 shown in FIG. 3. The drive shaft 23 drives a rotor 25 equipped with openings 24 along its circumference. The openings 24 trap a certain amount of air or vapor when the rotor 25 turns. The transmission ratio of the gear transmission can be chosen in such manner that the amount of air ultimately displaced by pump 7 is at least equal to the amount of fuel displaced by volumeter 5, so that possible losses or leaks do not result in vapor exhausts being released into the environment.

I claim:

1. A system for pumping a quantity of liquid in one direction and a corresponding quantity of vapour in the opposite direction, said system comprising:

a) a first tank (2);

b) a pump (4) coupled via a fluid duct to said first tank;

c) a volumeter (5) coupled via an inlet liquid duct to said pump, said volumeter being provided with an outlet liquid duct for coupling to a second tank for transferring liquid from said first tank (2) to the second tank;

d) a rotating air pump (7) having a rotating rotor (25) for pumping vapor therethrough, said pump (7) having an inlet air duct for coupling to the second tank, an inlet air duct coupled to said first tank (2) and a drive shaft (23) for rotating said rotor;

e) said volumeter (5) having at least one cylinder (11, 11') having first and second inlet passageways connected, respectively, to opposite ends of said cylinder and a liquid driven reciprocating piston (12, 12') and piston rod (13) connected to said piston, a rotatable crankshaft (10) having opposite ends coupled via said piston rod (13) to said piston for rotating movement upon reciprocating movement of said piston;

f) a valve (15) secured to one end of said crankshaft for cooperation with said passageways to alternately open one and close the other and to then open the other and close the one so as to alternatively allow said quantity of liquid to pass from opposite sides of said piston (12, 12') in said volumeter and to said outlet liquid duct and said second tank;

g) the drive shaft (23) of the air pump (7) is coupled to the other end of said crankshaft (10) for rotation therewith; and h) the rotor (25) of the air pump includes openings (24) in its circumference for trapping vapor as the rotor is rotated and moving the trapped vapor from the inlet air duct to the outlet air duct of said air pump whereby the quantity of vapor pumped through said air pump corresponds to the quantity of liquid pumped through said volumeter.

2. A system according to claim 1 wherein said volumeter (5) has two cylinders (11, 11') and two fluid driven reciprocating pistons (12, 12') coupled to said piston rod (13).

3. A system according to claim 1, said system further having a gear transmission (22) coupled between said crankshaft (10) and the drive shaft (23) connected to said rotor (25).

* * * * *